United States Patent [19]

Morita

[11] 4,236,304

[45] Dec. 2, 1980

[54] DEVICE FOR SPREADING APART A PAIR OF TAPES

[75] Inventor: Toyoo Morita, Kurobe, Japan

[73] Assignee: Yoshida Kogyo K.K., Tokyo, Japan

[21] Appl. No.: 974,612

[22] Filed: Dec. 29, 1978

[30] Foreign Application Priority Data

Dec. 30, 1977 [JP] Japan ..... 52/158064

[51] Int. Cl.[3] ..... B23P 19/04

[52] U.S. Cl. ..... 29/768

[58] Field of Search ..... 29/33.2, 408, 409, 766, 29/767, 768, 769, 770, 779, 809, 819

[56] References Cited

U.S. PATENT DOCUMENTS

| | | | |
|---|---|---|---|
| 3,078,558 | 2/1963 | Langwell | 29/768 X |
| 3,116,544 | 1/1964 | Fisher | 29/768 |
| 3,127,760 | 4/1964 | Bruning | 29/408 |
| 3,234,637 | 2/1966 | McMahon | 29/768 X |
| 3,600,786 | 8/1971 | Hansen | 29/768 |
| 3,689,980 | 9/1972 | Oyama | 29/408 |
| 3,812,573 | 5/1974 | Fukuroi | 29/770 X |

*Primary Examiner*—Ervin M. Combs

*Attorney, Agent, or Firm*—Hill, Van Santen, Steadman, Chiara & Simpson

[57] ABSTRACT

A device for spreading apart a pair of tapes such as a pair of slide fastener stringer tapes for enabling attachment of a slider thereto. The spreading device includes a pair of lower grip members movable away from each other on a horizontal base, and a pair of upper grip members vertically aligned with the lower grip members, respectively, and displaceable away from each other. The upper grip members are mounted through a pair of collapsible crossing links on a drive shaft vertically movable toward the base. The tapes are disposed on the lower grip members, respectively, and sandwiched firmly between the upper and lower grip members when the drive shaft is lowered to press the upper grip members against the lower grip members. Continued downward movement of the drive shaft causes the crossing links to collapse, whereupon the upper grip members and hence the lower grip members move away from each other, thereby spreading apart the tapes.

10 Claims, 14 Drawing Figures

DEVICE FOR SPREADING APART A PAIR OF TAPES

BACKGROUND OF THE INVENTION

1. Field of the Invention

The present invention relates to a device for spreading apart a pair of tapes such as a pair of slide fastener stringer tapes.

2. Prior Art

Sliders are installed onto a slide fastener chain through coupling-element-free gaps or spaces located at intervals in the chain, each of such spaces being widened by spreading apart the stringer tapes for accommodating the sliders one at a time therein. One known tape spreading device comprises a pair of tape gripping arms pivotally supported for moving the tapes away from each other. Such pivotally mounted arms, however, have a functional limitation such that they cannot be opened widely enough to permit easy mounting and removal of coupled fastener stringers, respectively, on and from the slider applying apparatus before and after a slider attaching operation.

SUMMARY OF THE INVENTION

According to the present invention, a pair of first grip members are slidably mounted on a table and movable away from each other in a direction transverse to a path along which a pair of tapes are supported on the table, and a pair of second grip members operatively coupled with a shaft drivable toward the table and facing the first grip members, the second grip members being movable away from each other along said direction. There is a means on the shaft for converting the motion of the shaft toward the table into the motion of the second grip members away from each other along said direction while the second grip members are pressed against and interlocked with the frist grip members with the pair of tapes held therebetween.

An object of the present invention is to provide a tape spreading device onto and from which a pair of tapes can be installed and removed with ease.

Many other advantages, features and additional objects of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

Figure 1:
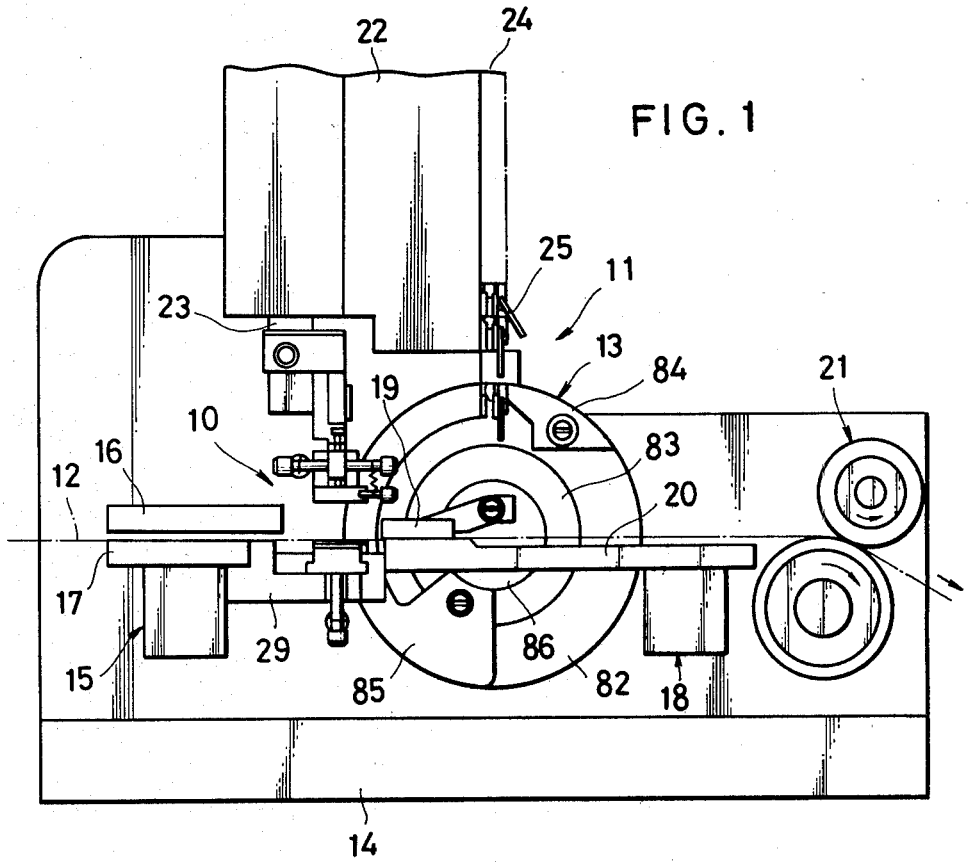
FIG. 1 is a front elevational view of a slider attaching apparatus having a tape spreading device constructed in accordance with the present invention.

The present invention is particularly useful when embodied in a spreading device such as shown in FIG. 1, generally indicated by the numeral 10.

The spreading device 10 is employed for spreading apart a pair of tapes 12, 12 (FIG. 3) such as a pair of slide fastener stringer tapes, and is contained in a slider attaching apparatus 11 including a slider supplying unit 13 operatively associated with the spreading device 10. The slider attaching apparatus 11 has a frame 14, a first guide 15 having a pair of upper and lower guide plates 16, 17, a second guide 18 having a movable upper guide plate 19 and a fixed lower guide plate 20. The stringer tapes 12, 12 are transported through the first guide 15, the spreading device 10, and the second guide 18 by a discharge roll unit 21 rotatably mounted on the frame 14. A motor housing 22 mounted on the frame 14 contains a motor (not shown) operatively coupled with a vertically reciprocable drive arm of shaft 23 through a suitable cam or link mechanism (not shown). The motor housing 22 is equipped with a vertical chute 24 along which a series of sliders 25 are fed to the slider supplying unit 13.

Figure 2:
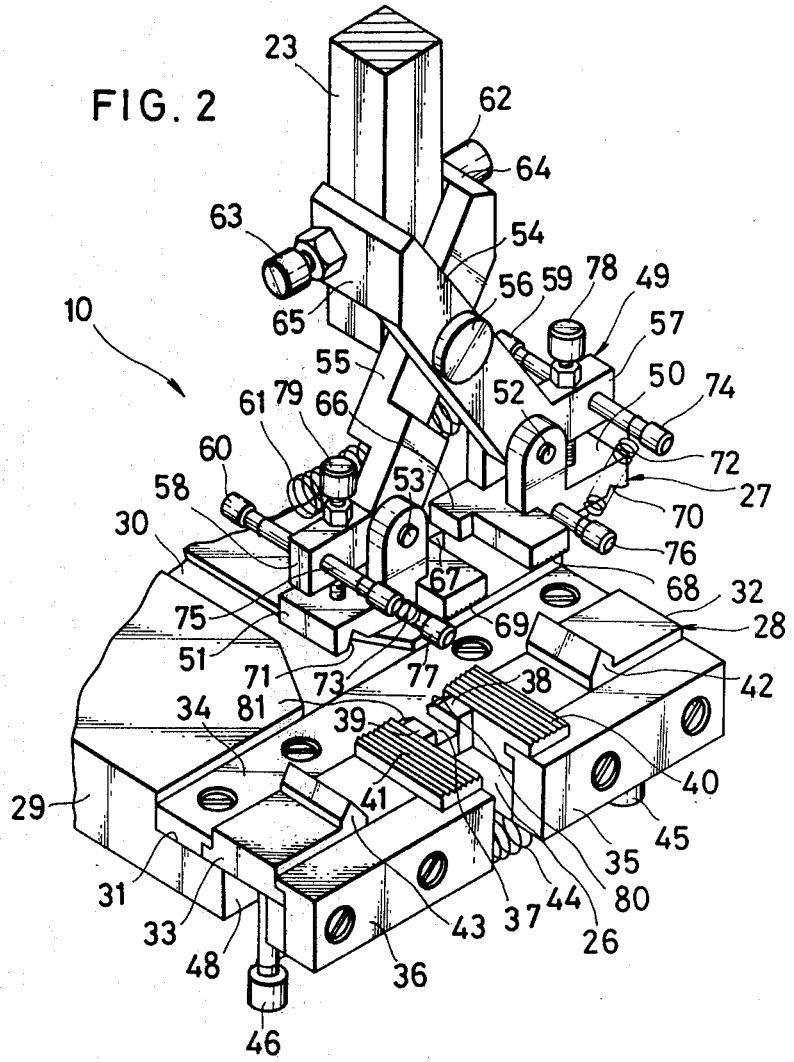
FIG. 2 is an enlarged perspective view of the tape spreading device.
Figure 3:
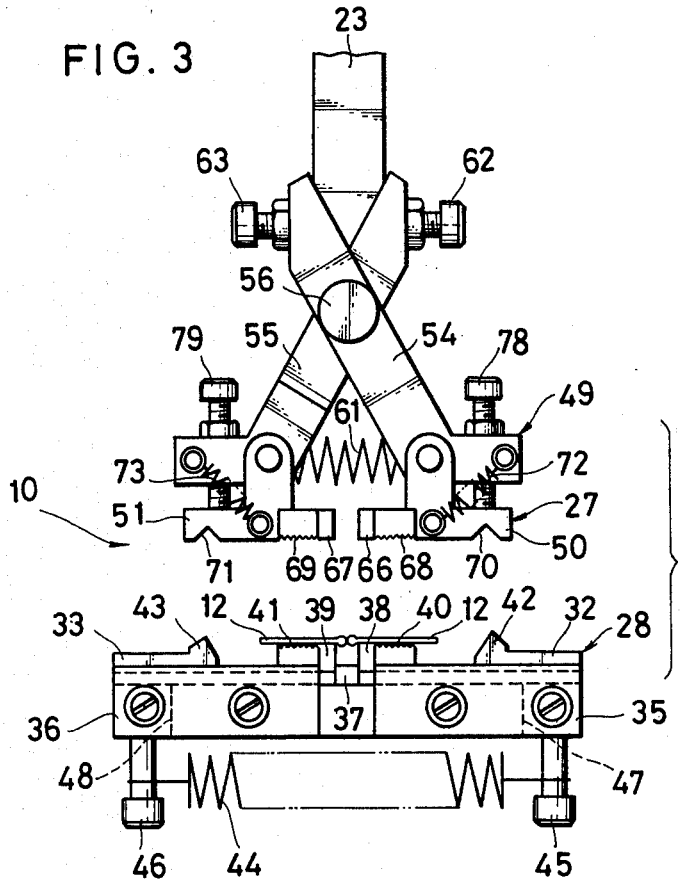
FIG. 3 is a front elevational view of the tape spreading device.

As shown in FIGS. 2 and 3, the spreading device 10 essentially comprises an upper grip assembly 27 supported on the drive shaft 23, a lower grip assembly 28 slidably mounted on a table 29 fixed to the frame 14. The table 29 has a groove 30 for guiding the pair of stringer tapes 12, 12 to move in a path therealong, a recess 31 in which the lower grip assembly 28 is slidable, and a slot 26 located at the recess 31 in alignment with the groove 30. The lower grip assembly 28 includes a pair of grip assembly members 32, 33 horizontally movable toward and away from each other in a direction substantially perpendicular to the groove 30, namely transversely to said path of tape movement. The grip members 32, 33 are confined to such a motion by a retainer 34 and a pair of spaced retainers 35, 36, all bolted to the table 29. The retainer 34 has a central projection 37 acting as a spacer between the lower grip members 32, 33, the spacer 37 extending into the slot 26 in alignment with the groove 30.

The lower grip members 32, 33 have a pair of projections 38, 39 extending toward each other and acting as tape-edge pressers, the function of which is described in detail below, the projections 38, 39 being normally held against the spacer 37 to keep the lower grip members 32, 33 spaced apart from each other. The projections 38, 39 have a pair of tapered upper surfaces 80, 81, respectively, that are inclined downwardly toward the groove 30. The lower grip members 32, 33 have knurled or otherwise roughened grip surfaces 40, 41, respectively, disposed immediately adjacent to or just behind the projections 38, 39. The grip surfaces 40, 41 are located one on each side of the slot 26 in the table 29 and are directed upwardly toward the upper grip assembly 27. The lower grip members 32, 33 also have a pair of upwardly projecting ridges or teeth 42, 43, respectively, spaced from the grip surfaces 40, 41. A tension spring 44 acts between a pair of pins 45, 46 extending downwardly from the lower grip members 32, 33, respectively, and normally urges the lower grip members 32, 33 toward each other, there being a pair of openings 47, 48 in the table 29 for accommodating the pins 45, 46, respectively.

The upper grip assembly 27 comprises a pair of grip members 50, 51 pivotally mounted by a pair of pivot pins 52, 53, respectively, on a pair of crossing links 54, 55, respectively, pivotally mounted by a pivot pin 56 on a lower end of the drive shaft 23. The links 54, 55 have a pair of horizontal end portions 57, 58, respectively, extending away from each other, on which a pair of pins 59, 60 are mounted, respectively. A tension spring 61 acts between the pins 59, 60 and normally urges the end portions 57, 58 and hence the upper grip members 50, 51 toward each other. A pair of setscrews 62, 63 threadedly extend through a pair of vertical portions 64, 65 of the links 55, 54, respectively into abutting engagement with the drive shaft 23. By turning the setscrews 62, 63, the distance by which the upper grip members 50, 51 are spaced can be varied. The upper grip members 50, 51 have a pair of projections 66, 67, respectively, also functioning as tape-edge pressers and extending toward each other. A pair of knurled grip surfaces 68, 69 are provided on the upper grip members 50, 51 respectively, and are directed downwardly so as to face the lower grip surfaces 40, 41, respectively. The setscrews 62, 63 are adjusted so that the upper projections 66, 67 are vertically aligned with the lower projections 38, 39, respectively, and the upper grip surfaces 68, 69 are vertically aligned with the lower grip surfaces 40, 41, respectively. The upper grip members 50, 51 have a pair of notches 70, 71, respectively, opening downwardly for receiving the teeth 42, 43 on the lower grip members 32, 33 when the upper grip 27 is lowered into abutment against the lower grip 28.

A pair of pins 74, 75 are fixed to the end portions 57, 58 of the links 54, 55, respectively, and a pair of pins 76, 77 are fixed to the upper grip members 50, 51, there being a pair of tension springs 72, 73 extending between the pins 74, 76 and between the pins 75, 77, respectively, and normally urging the upper grip members 50, 51 respectively against the ends of a pair of setscrews 78, 79 threadedly extending through the end portions 57, 58 of the links 54, 55. The upper grip members 50, 51 are held substantially parallel to the lower grip members 32, 33 by the setting of the setscrews 78, 79.

Figure 4:
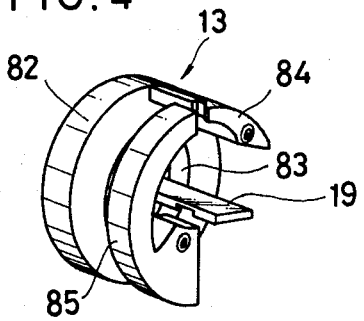
FIG. 4 is a perspective view of a slider supplying unit.

The slider supplying unit 13 shown in FIGS. 1 and 4 comprises an outer ring 82 and an inner ring 83 disposed concentrically within the outer ring 82, the outer ring 82 having a first slider support member 84 and the inner ring 83 having a second slider support member 85 extending through the slot 26 in the table 29. The outer and inner rings 82, 83 are independently angularly movable by a suitable drive mechanism (not shown), which may comprise a rack and pinion for each ring 82, 83. The first and second slider support members 84, 85 jointly hold therebetween one of the sliders 25 as it is discharged from the chute 24. A central disk 86 is mounted coaxially within the inner ring 83 and supports thereon the upper guide plate 19, the central disk 86 being angularly movable as by a rack-and-pinion mechansim (not shown).

Figure 5A:
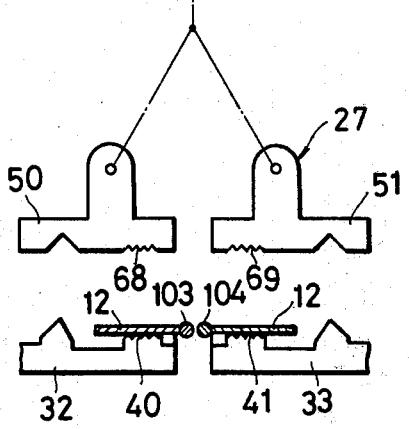
FIGS. 5A through 5F are fragmentary rear elevational views of the tape spreading device, illustrative of successive positions of the working parts of the device.
Figure 5B:
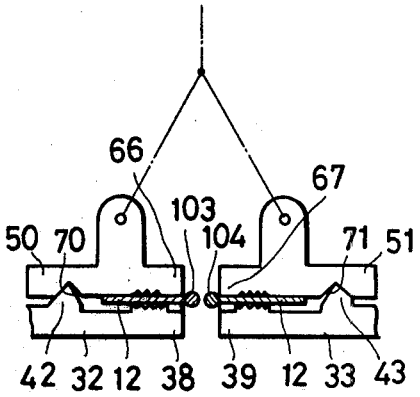
Figure 5C:
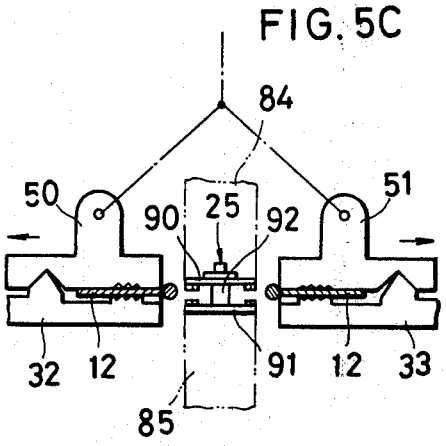
Figure 5D:
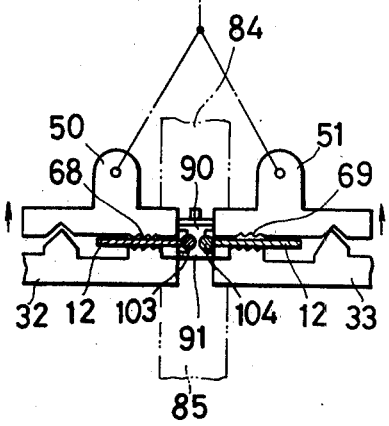
Figure 6A:
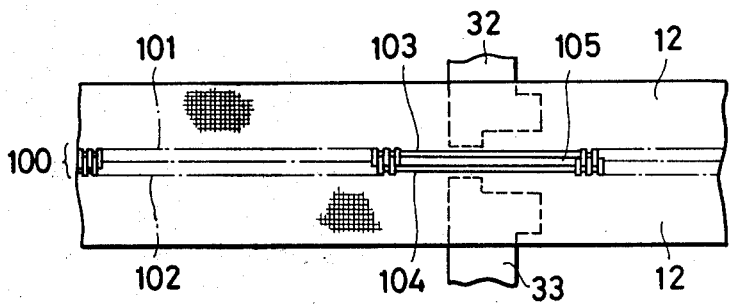
FIGS. 6A through 6D are fragmentary plan views successively showing the way in which a pair of stringer tapes are displaced away from and toward each other at a coupling-element-free space while the stringer chain is equipped with a slider.
Figure 6B:
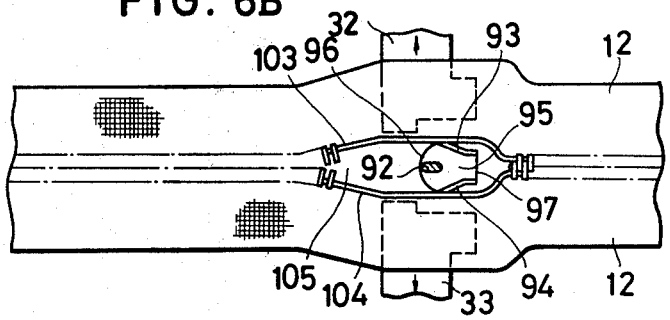
Figure 6C:
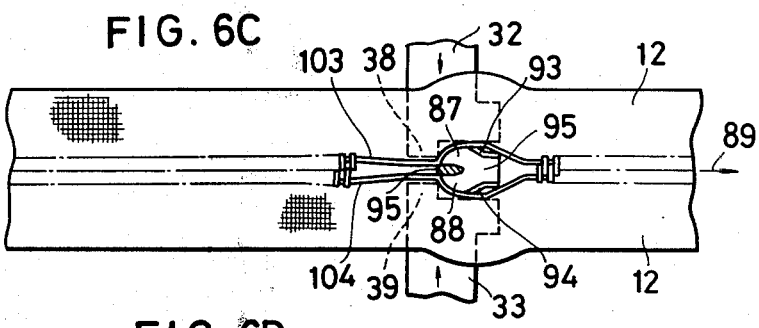

As illustrated in FIGS. 5C, 5D and 6B, 6C, the slider 25 is composed of a pair of upper and lower wings or shields 90, 91 interconnected by a neck or separator 92, each of the wings 90, 91 having a pair of side flanges 93, 94. The neck 92 and the side flanges 93, 94 on the wings 90, 91 jointly provide a generally Y-shaped channel 95 in the slider 25 for the passage therethrough of a pair of rows of coupling elements. As best shown in FIGS. 6B and 6C, the slider 25 has a widened front end 96 at which the neck 92 is disposed, and a contracted rear end 97 located remotely from the front end 96. The Y-shaped guide channel 95 has a pair of throats 87, 88 one on each side of the neck 92.

As best shown in FIG. 6A, the stringer tapes 12, 12 have a chain 100 of interengaged rows of coupling elements 101, 102 mounted respectively on their opposed beaded or bulged edges 103, 104, which are relatively stiff to provide rigid support for the coupling elements 101, 102. There are a plurality of coupling-element-free gaps or spaces 105 (FIGS 6A and 6D) in the chain 100 which are located at spaced intervals therealong.

The operation of the apparatus 10 is as follows. The stringer tapes 12, 12 are transported through the first and second tape guides 15, 18 until one of the element-free gaps 105 is positioned over the slot 26 in the table 29, that is, between the upper and lower grip assemblies 27, 28, at which time the tapes 12, 12 are disposed on the lower grip surfaces 40, 41, respectively, (FIGS. 5A and 6A) with the projections 38, 39 just behind the beaded edges 103, 104, respectively. The drive shaft 23 is lowered to cause the upper grip surfaces 68, 69 to be pressed against the tapes 12, 12 on the lower grip surfaces 40, 41, whereupon the teeth 42, 43 are received in the notches 70, 71, respectively (FIG. 5B). At this time, the projections 66, 67 on the upper grip members 50, 51 are positioned just behind the beaded tape edges 103, 104, respectively. The drive shaft 23 is further depressed to cause the links 54, 55 to start collapsing with the setscrews 62, 63 disengaged from the shaft 23 and the end portions 57, 58 moving apart, thereby enabling the upper grip members 50, 51 to horizontally move apart from each other against the bias of the spring 61. The lower grip members 32, 33, with their teeth 42, 43 in the notches 70, 71, move apart in response to the spreading movement of the upper grip members 50, 51, whereby the stringer tapes 12, 12 firmly sandwiched or gripped between the upper grip surfaces 68, 69 and the lower grip surfaces 40, 41 become spread open (FIG. 5C).

Then, the inner ring 83 is angularly moved to allow the second slider support member 85 to pass upwardly through the slot 26 in the table 29 and the held open gap 105 and toward the first slider support member 84 that is disposed below the chute 24. One of the sliders 25 that is discharged from the chute 24 is held between the first and second slider support members 84, 85, and then is brought downwardly by simultaneous angular movement of the outer and inner rings 82, 83 toward a position just between the separated tapes 12, 12 (FIGS. 5C and 6B). The drive shaft 23 is now raised to permit the upper grip members 50, 51 and hence the lower grip members 32, 33 to move toward each other under the force of the springs 61, 44 until the setscrews 62, 63 on the links 54, 55 abut against the drive shaft 23. At this time, the stringer tapes 12, 12 move toward each other until the projections 38, 39 and 66, 67 press or urge the beaded edges 103, 104 closely together in front of the neck 92 of the slider 25 with portions of the beaded edges 103, 104 held against the side flanges 93, 94 and extending across the throats 87, 88 of the slider 25 (FIG. 6C). The drive shaft 23 is then slightly lifted to raise the upper grip members 50, 51 (FIG. 5D) to such an extent that the tapes 12, 12 can longitudinally move between the upper grip surfaces 68, 69 and the lower grip surfaces 40, 41 and at the same time the beaded edges 103, 104 can still be held together by the upper projections 66, 67 and the lower projections 38, 39.

Figure 5E:
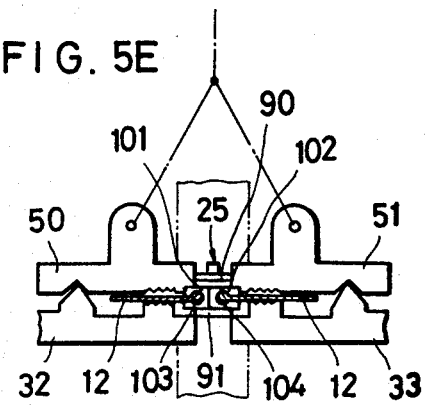
Figure 5F:
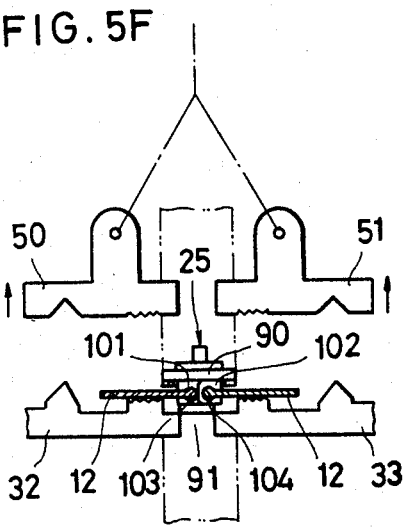
Figure 6D:
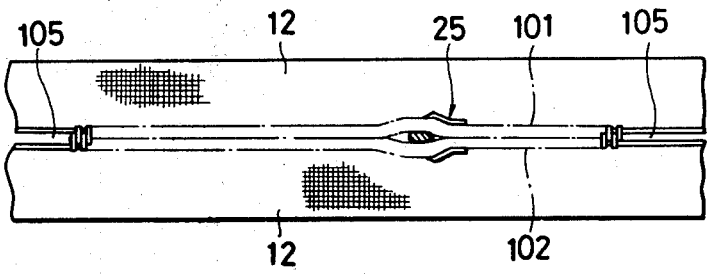

The stringer tapes 12, 12 are pulled along by the discharge roll unit 21 in the direction of the arrow 89 (FIG. 6C) until the end of the rows of coupling elements 101, 102 abuts against the projections 38, 39 and 66, 67 (FIG. 5E). The advancing movement of the tapes 12, 12 is temporarily stopped, and then the drive shaft 23 is retracted upwardly to lift the upper grip members 50, 51 further away from the lower grip members 32, 33 (FIG. 5F). The stringer tapes 12, 12 are advanced again, whereupon the rows of coupling elements 101, 102 move onto and slide along the tapered surfaces 80, 81, and are separated by the slider neck 92 as they enter the slider 25 through the throats 87, 88, with the beaded edges 103, 104 being squeezed between the side flanges 93, 93 and between the side flanges 94, 94, respectively, into the slider 25. The stringer tapes 12, 12 are continuously pulled to cause the rows of coupling elements 103, 104 to become interengaged again as they are issued out of the slider 25 from its contracted rear end 97 (FIG. 6D). The outer and inner rings 82, 83 then are angularly moved in opposite directions such that the slider support members 84, 85 move away from each other to release the slider 25. One cycle of operation is thus completed.

Although various minor modifications might be suggested by those versed in the art, it should be understood that I wish to embody within the scope of the patent warranted hereon, all such embodiments as reasonably and properly come within the scope of my contribution to the art.

I claim:

1. A device for spreading a pair of stringer tapes apart at an element-free gap, comprising:

(a) a frame having a table for supporting thereon the pair of tapes along a longitudinal path;

(b) a pair of first grip members slidably mounted on said table and movable away from each other in a direction transverse to said path, and adapted to engage one side of the tapes at the element-free gap, respectively;

(c) a shaft movably supported on said frame and drivable toward said first grip members;

(d) a pair of second grip members operatively coupled with said shaft and facing said first grip members for engaging the other side of the tapes at the element free gap respectively, said second grip members being movable away from each other along said direction; and (e) means on said shaft for converting the motion of said shaft toward said table into the motion of said second grip members away from each other along said direction while said second grip members are pressed against said first grip members with the pair of tapes held therebetween.

2. A device according to claim 1, including spring means acting between said first grip members and urging them toward each other.

3. A device according to claim 1, said converting means comprising a pair of crossing links pivotally connected to said shaft at a position between their ends, said second grip members being supported on said links, respectively.

4. A device according to claim 3, each of said second grip members being pivotably mounted on one of said links, a set screw adjustably extending through each of said links for endwise engagement with a corresponding one of said second grip members, and spring means acting between each of said links and a corresponding one of said second grip members and normally urging said one of the second grip members against the end of said set screw so as to keep said second grip members substantially parallel to said first grip members.

5. A device according to claim 1, each of said first and second grip members having confronting gripping surfaces having cooperating ridges extending in the direction of said longitudinal path.

6. A device according to claim 1, including interfitting means on said first and second grip members for directly locking them together for joint movement during the motion of said second grip members away from each other.

7. A device according to claim 6, said locking means comprising a pair of teeth spaced from the path of said stringer tapes and disposed respectively on said first grip members, said second grip members having a pair of notches for receiving said teeth, respectively.

8. A device for spreading a pair of stringer tapes apart, comprising:

(a) a frame having a table for supporting thereon the pair of tapes along a longitudinal path;

(b) a pair of first grip members slidably mounted on said table and movable away from each other in a direction transverse to said path, said first grip members having a pair of first grip surfaces, respectively, adjacent to their confronting edges;

(c) a shaft movably supported on said frame and drivable longitudinally of its own length toward said table;

(d) a pair of second grip members operatively coupled with said shaft and movable away from each other along said direction, said second grip members having a pair of second grip surfaces, respectively, adjacent to their confronting edges, said first and second grip surfaces facing each other for sandwiching the stringer tapes therebetween;

(e) collapsible linkage means on said shaft responsive to engagement between said first and second grip members for converting the further motion of said shaft toward said table into the motion of said second grip members away from each other along said direction; and (f) means on said first and second grip members remote from their confronting edges for directly interlocking said first and second grip members.

9. A device according to claim 8, each of said first and second grip surfaces having a plurality of ridges extending parallel to said longitudinal path.

10. A device according to claim 8, said interlocking means comprising a pair of teeth and a pair of notches receptive of said teeth and disposed respectively on said first and second grip members, said teeth and notches extending parallel to said longitudinal path.

* * * * *